US005558500A

United States Patent [19]

Elliott et al.

[11] Patent Number: 5,558,500

[45] Date of Patent: Sep. 24, 1996

[54] ELASTOMERIC SEAL FOR AXIAL DOVETAIL ROTOR BLADES

[75] Inventors: Bob Elliott, Phoenix; Devinder N. Katariya, Chandler; Robert G. Minnick, Chandler; Rita A. Peralta, Chandler; Ronald J. Rich, Phoenix; Daniel M. Voron, Tempe, all of Ariz.; Michael J. Cave, Oceanside, Calif.

[73] Assignee: AlliedSignal Inc., Morris Township, N.J.

[21] Appl. No.: 609,095

[22] Filed: Feb. 29, 1996

Related U.S. Application Data

[63] Continuation of Ser. No. 253,439, Jun. 7, 1994, abandoned.

[51] Int. Cl.[6] ..... F04D 29/34

[52] U.S. Cl. ..... 416/220 R; 416/221

[58] Field of Search ..... 416/219 R, 220 R, 416/221, 248

[56] References Cited

U.S. PATENT DOCUMENTS

| | | | |
|---|---|---|---|
| Re. 33,954 | 6/1992 | Honda et al. | 416/219 R |
| 2,595,829 | 12/1946 | Dean . | |
| 2,847,187 | 1/1955 | Murphy . | |
| 2,928,651 | 1/1955 | Turnbull . | |
| 3,572,970 | 3/1971 | Smuland . | |
| 3,598,503 | 8/1971 | Muller . | |
| 3,784,320 | 1/1974 | Rossmann et al. | 416/219 R |
| 3,841,792 | 10/1974 | Amos.. | |
| 4,019,832 | 4/1977 | Salemme et al. | 416/219 R |
| 4,451,205 | 3/1984 | Honda et al. | 416/219 R |
| 5,123,813 | 6/1992 | Przytulski et al. | 416/219 R |
| 5,137,420 | 8/1992 | Sigworth et al. | 416/248 |
| 5,139,389 | 8/1992 | Eng et al. | 416/248 |
| 5,191,711 | 3/1993 | Vickers et al. . | |
| 5,236,309 | 8/1993 | Van Heusden et al. | 416/248 |
| 5,257,909 | 11/1993 | Glynn et al. . | |
| 5,282,720 | 2/1994 | Szpunar | 416/219 R |
| 5,313,786 | 5/1994 | Chlus et al. . | |

*Primary Examiner*—John T. Kwon

*Attorney, Agent, or Firm*—Jerry J. Holden; James W. McFarland

[57] ABSTRACT

A rotor assembly for a gas turbine engine has a disc with dovetail grooves and a plurality of blades with dovetail roots contoured to be received within the grooves. The inner surface of a flexible, high temperature, low compression set seal is bonded to the inner surface of each root portion. The outer surface of the seal has two portions inclined at an angle and spaced apart to define a surface portion for sealingly contacting the base of the groove. The longitudinal edges of the outer surface are curved to facilitate assembly.

4 Claims, 2 Drawing Sheets

ELASTOMERIC SEAL FOR AXIAL DOVETAIL ROTOR BLADES

This application is a continuation of application Ser. No. 08/253,439 filed Jun. 7, 1994, now abandoned.

TECHNICAL FIELD

The present invention relates to gas turbine engines, and in particular, to devices for sealing between axial dovetail blades and compressor rotor discs.

BACKGROUND OF THE INVENTION

Gas turbine engines are used on aircraft in the form of a jet or turboprop engine to supply propulsion or as an auxiliary power unit to drive air compressors, pumps, and electric generators. They are also used to power ships, ground vehicles, and as stationary power supplies.

Referring to FIG. 1, a type of compressor disc 2 used in gas turbine engines has a plurality of compressor blades 4 having dovetail shaped roots 6 mounted in correspondingly shaped grooves 8. A metallic retainer clip 10 is disposed between the root 6 and the groove 8 and secures the blade 4 to the disc 2. Air leakage between the roots 6 and the grooves 8 is minimized by an elastomeric seal 9 glued to the inside of the retainer clip 8.

A drawback to prior art metallic retainer clips is that when they come lose from the grooves, they can damage engine components, such as blades and vanes, located downstream.

Accordingly, there is a need for an apparatus for directly sealing between axial dovetail blades and compressor rotor discs.

SUMMARY OF THE INVENTION

An object of the present invention is to provide an apparatus for directly sealing between axial blades and compressor rotor discs.

The present invention achieves this objective by providing a rotor assembly for a gas turbine engine having a disc with dovetail grooves and a plurality of blades with dovetail roots contoured to be received within the grooves. A flexible, high temperature, low compression set seal is bonded to the dovetail roots. The seal has an outer surface with two portions inclined at an angle and spaced apart to define a surface portion for sealingly contacting the base of the groove. This outer surface has curved longitudinal edges to facilitate assembly.

DESCRIPTION OF THE PREFERRED EMBODIMENT

Figure 1:
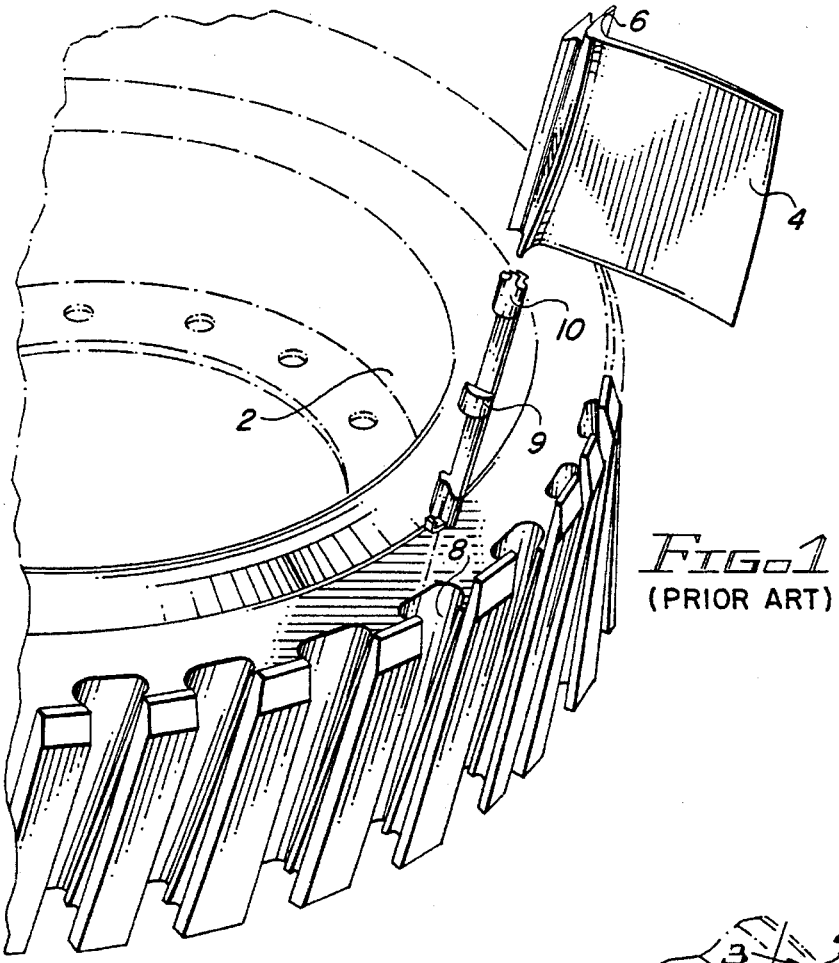
FIG. 1 (PRIOR ART)
FIG. 1 is an exploded view of a prior art compressor rotor assembly.
Figure 2:
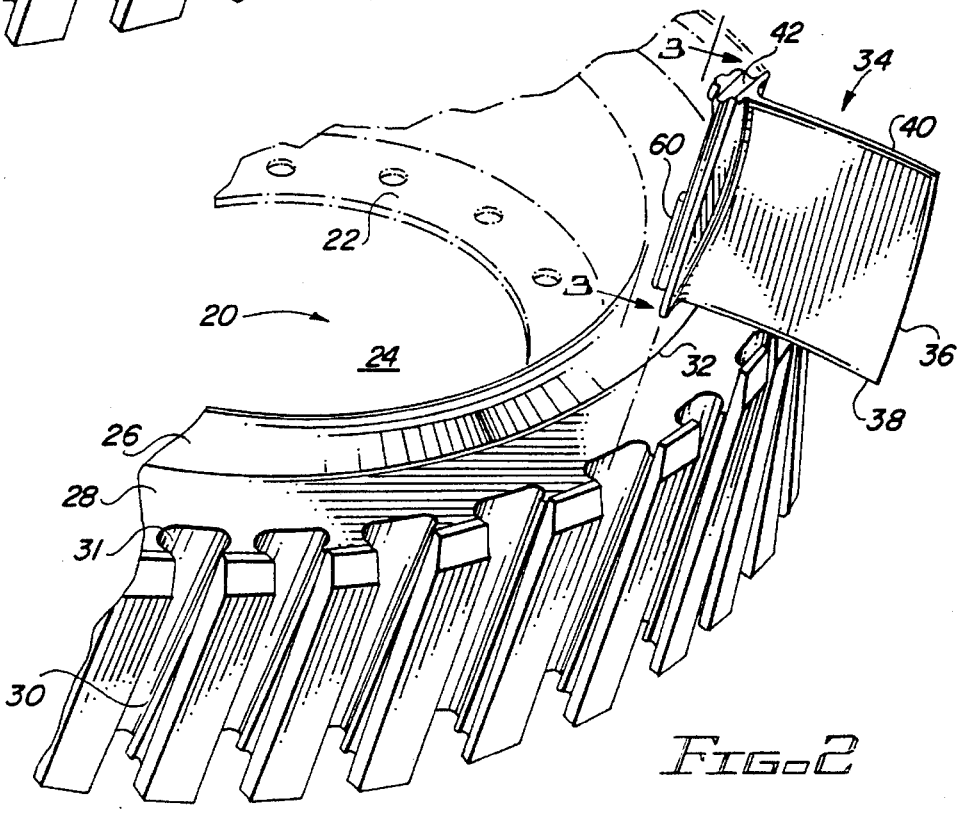
FIG. 2 is an exploded view of a compressor rotor assembly contemplated by the present invention.
Figure 3:
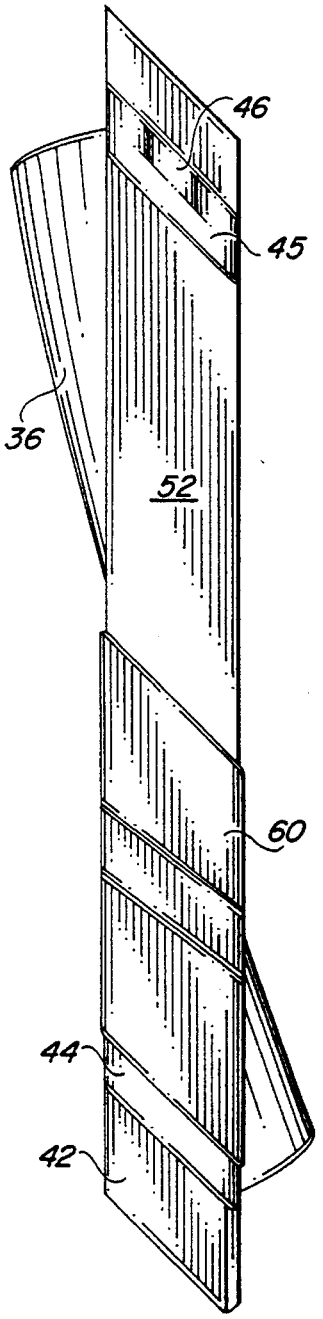
FIG. 3 is a bottom view, taken along line 3—3, of the blade shown in the assembly of FIG. 2.

Referring to FIG. 2, a compressor disc is generally denoted by the reference numeral 20. The disc 20 includes an annular flange portion 22 which defines an axially extending central through bore 24. Extending radially from the flange portion 22 is a web portion 26 followed by an outer periphery 28 having a plurality of dovetailed configured grooves 30 with radially outward facing base surface 31. The grooves 30 extend through the periphery 28 at an angle between the disc's axial and tangential axes referred to as disc slot angle represented by line 32.

Figure 4:
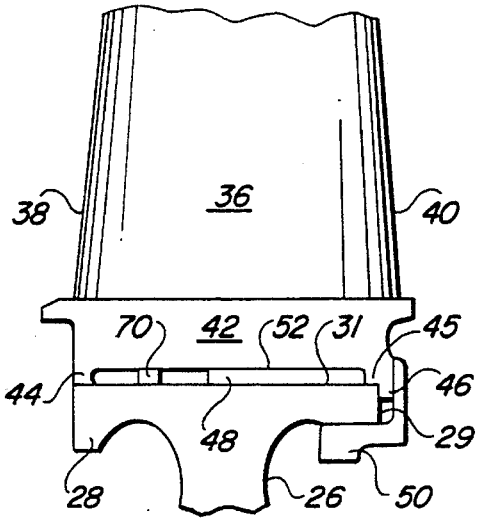
FIG. 4 is a side view of a portion of the rotor assembly of FIG. 2.
Figure 6:
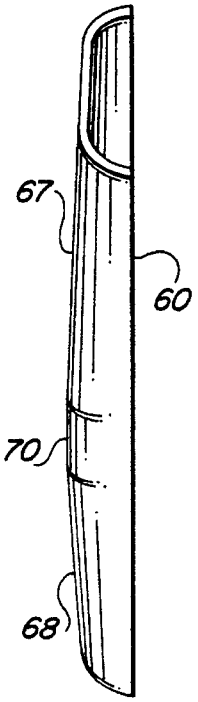
FIG. 6 is a side view taken along line 6—6 of FIG. 5.

Compressor blades 34 are carried upon the outer periphery 28. Each blade 34 includes a radially upstanding airfoil portion 36 that extends from a leading edge 38 to a trailing edge 40 and a root portion 42 which is dovetail shaped to be received by one of the grooves 30. At its leading and trailing edges the root portion 36 has tabs 44,45 that extend radially inward toward the base surface 31 to define a gap 48 between the base surface 31 and an inner surface 52 of the root portion 42. (see FIG. 4). A tab 46 adjacent the tab 45 extends further inward and abuts an axial surface 29 of the outer periphery 28. In a manner familiar to those skilled in the art, a retaining ring 50 holds the tab 46 against the axial surface 29 thereby holding the blade 34 within the groove 30. Because of the pressure differential across the blade 34, air will leak under the tab 44, through the gap 48, and then under the tabs 45 and 46.

To minimize this leakage an elastomeric seal 60 is press fit between the inner surface 52 and the base of the groove 1. Alternatively, the seal 60 bonded to the inner surface 52 by an adhesive which conforms with Military Specification MIL-A-46050C, type II, class 2 and is applied to the top surface 72 of the seal 60. The elastomeric seal 60 can be located anywhere along the length of the surface 52 and is preferably made of any silicone rubber suitably cured to have the following properties.

TABLE I

| | After Curing | After Aging for 7 Days at 500° F. |
|---|---|---|
| Hardness, Shore A | 70 | 85 max. |
| Tensile Strength, psi | 750 min. | 600 min. |
| Elongation | 110% min. | 70% min. |
| Compression Set after 22 hrs. at 500° F., and 25% deflection | 60% max. | |

Figure 5:
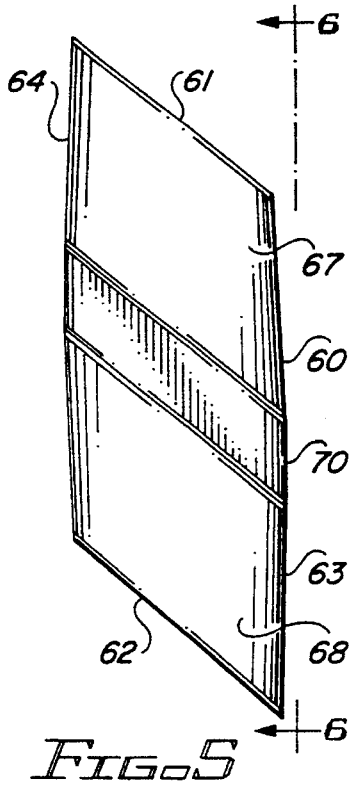
FIG. 5 is a bottom view of the seal used in the assembly of FIG. 2.

The seal 60 is bounded by lateral edges 61, 62 and longitudinal edges 63, 64 and is generally shape as a parallelogram except that the edges 63,64 are curved slightly towards each other so that the width of the seal 60 at the edges 61,62 is about eight percent less than at the seal's middle. The bottom surface of the seal 60 has two surface portions 67, 68 that are spaced apart to define therebetween a sealing surface 70. The portions 67,68 incline at an angle as they extend from the sealing surface 70 towards the edges 61,62 respectfully. As a result the height of the seal 60 at the sealing surface 70 is about thirty percent greater than the height at the edges 61,62. Alternatively, the bottom surface of the seal 60 may have only one inclined portion. As shown in FIG. 5, the sealing surface 70 is parallel to the edges 61,62 and is extended longitudinally a sufficient distance to be able to resist the pressure force applied by the leaking air. A silicone lubricant is applied to the surfaces 67, 68, and 70, especially if the seal 60 is not bonded the surface 52.

Because of the orientation of the sealing surface 70 and the curvature the edges 63,64, contact between the surface 70 and the base 31 of the groove 30 does not occur until the seal has been partially inserted, thus facilitating the assembly of the blades 40 into the grooves 30. Once contact occurs only an axial force is exerted on the seal 60, not a tangential force which can cause pinching, binding, and tearing of the seal. Importantly, should the seal 60 come loose it will not damage any downstream components.

Various modifications and alterations to the above described preferred embodiment will be apparent to those skilled in the art. Accordingly, this description of the invention should be considered exemplary and not as limiting the scope and spirit of the invention as set forth in the following claims.

What is claimed is:

1. A rotor assembly for a gas turbine engine, comprising:

a disc having along its periphery circumferentially spaced dovetail grooves, a blade having an airfoil portion and a root portion, said root portion contoured to be received within said dovetail groove and having an inner surface that extends axially from a leading edge to a trailing edge, said leading and trailing edges each having a tab member extending inward therefrom to define a gap between said inner surface and a base of said groove; and an elastomeric member disposed in said gap and having a top surface bonded to said inner surface of said root portion and a bottom surface having two portions inclined at an angle and spaced apart to define a surface portion therebetween for sealingly contacting said base of said groove.

2. The rotor assembly of claim 1 wherein said elastomeric member has a top surface shaped as a parallelogram.

3. The rotor assembly of claim 2 wherein said top surface has curved longitudinal edges.

4. The rotor assembly of claim 1 wherein said elastomeric member has the following properties;

| | After Curing | After Aging for 7 Days at 500° F. |
|---|---|---|
| Hardness, Shore A | 70 | 85 max |
| Tensile Strength, psi | 750 min | 600 min |
| Elongation | 60% min. | 70% min |
| Compression Set after 22 hrs at 500° F., and 25% deflection | 60. | |

* * * * *